United States Patent [19]

O'Keeffe et al.

[11] Patent Number: 4,761,927

[45] Date of Patent: Aug. 9, 1988

[54] PANELIZED ENCLOSURE SYSTEM WITH REVERSE CAMBER SEAL

[75] Inventors: William F. O'Keeffe; Sonny Q. Garcia, both of San Francisco, Calif.

[73] Assignee: O'Keeffe's, Inc., San Francisco, Calif.

[21] Appl. No.: 44,288

[22] Filed: Apr. 30, 1987

[51] Int. Cl.[4] ..... E04B 1/62

[52] U.S. Cl. ..... 52/403; 52/459; 52/764; 52/582

[58] Field of Search ..... 52/403, 764, 761, 395, 52/81, 827–830, 459, 582

[56] References Cited

U.S. PATENT DOCUMENTS

| | | | |
|---|---|---|---|
| 2,145,469 | 1/1939 | Weinland | 52/403 |
| 3,343,324 | 9/1967 | Gordon | 52/403 |
| 3,488,901 | 1/1970 | Peterschmidt | 52/81 |
| 3,945,160 | 3/1976 | Grosser | 52/81 |
| 4,075,811 | 2/1978 | Keith | 52/395 |
| 4,149,346 | 4/1979 | Belt | 52/81 |
| 4,455,803 | 6/1984 | Kornberger | 52/395 |
| 4,606,162 | 8/1986 | Wendt | 52/395 |
| 4,611,441 | 9/1986 | Wickers | 52/81 |
| 4,622,794 | 11/1986 | Geortner | 52/403 |

FOREIGN PATENT DOCUMENTS

| | | | |
|---|---|---|---|
| 1225796 | 7/1960 | France | 52/403 |

*Primary Examiner*—Henry E. Raduazo

*Attorney, Agent, or Firm*—Fliesler, Dubb, Meyer & Lovejoy

[57] ABSTRACT

A panelized enclosure system 20 includes first and second panel structures 30,32 comprised of rafters 22,24 and panels 26, 28. The rafters 22,24 include exterior sides 34, 36 and interior sides 38, 40 joined together with peripheral sides 42, 44. The peripheral sides 42, 44 of two adjacent rafters 22, 24 define a reverse camber. The system 20 includes an interconnection 60 for interconnecting the panel structures 30, 32 and a seal 61 for sealing the panel structures 30, 32 together. The system 20 can be used to enclose an environment and isolate it from an ambient environment. The enclosed isolated environment can be at a pressure which is higher than that of the ambient environment. Accordingly, the panel structures 30, 32 are urged outwardly. As this occurs, the peripheral sides 42, 44 are pivotally urged together. As this pivoting occurs, the camber is reduced as the peripheral sides 42, 44 become more parallel thus further squeezing the sealant between the peripheral sides 42, 44 to ensure that the isolated environment is maintained.

5 Claims, 3 Drawing Sheets

PANELIZED ENCLOSURE SYSTEM WITH REVERSE CAMBER SEAL

FIELD OF THE INVENTION

The present invention relates to a panelized enclosure system comprised of a plurality of fitted together panel structures.

BACKGROUND OF THE INVENTION

A number of modular enclosure structures are presently available. The structures can be generally comprised of repeating components which are fastened together at appropriate intervals.

Also available in the prior art are a number of enclosure units which can isolate an environment from the general surroundings such that liquids and gases in the ambient environment can be kept out of the isolated environment.

There is an ever present need, however, to provide for modular type structures which are easy to fabricate yet provide an environment which is isolated from the ambient environment.

SUMMARY OF THE INVENTION

The present invention is directed toward providing a panelized enclosure system which is quick and easy to fabricate, which is tolerant with respect to alignment requirements during construction yet which is impermeable to liquids and gases so as to provide an appropriate isolated environment.

The present invention includes a panelized enclosure system having a plurality of panel structures each panel structure having a panel and a rafter for supporting each panel. The system further provides for the flexibly interconnecting and sealing together of the panel structures to form the enclosure system. Each rafter includes an exterior side, an interior side and a peripheral side which joins the exterior and the interior sides. The interconnecting means positions the peripheral sides of adjacent rafters together. The peripheral sides slope inwardly from the exterior side to the interior side such that the adjacent peripheral sides define a reverse camber there between. The interconnection more losely secure the panel structure adjacent the interior sides than the exterior sides.

A seal is provided between the peripheral sides. With the panel structures being more losely secured adjacent the interior sides than the exterior sides, the exterior sides act as a pivot point. Thus, in a situation where the pressure of the isolated environment exceeds the pressure of the ambient environment, panel structures are urged outwardly into the ambient environment, pivoting about the interconnection, and compressing the seal which is formed between the peripheral sides. This design thus further ensuring that liquids and gases cannot penetrate the enclosure.

In the system, the rafter is substantially C-shaped in cross-section with the panel secured to the exterior side.

The seal for sealing the panel structures together includes finger gaskets which extend from each of the rafter substantially at the position where the peripheral side joins the interior side. These finger gaskets slide over each other and allow for the movement of one panel structure with respect to the other and in particular movement adjacent the interior sides. This movement would occur should the pressure inside the isolated environment vary with respect to the pressure on the ambient environment. The fingers further provide a stop so that sealants can be provided between the peripheral sides.

The sealants positioned between the peripheral sides include a combination of sealants which are both gas impermeable and also sealants which are liquid impermeable in addition to sealants which are capable of withstanding weather associated with an ambient environment.

The interconnection further provides for internal cavities formed in the exterior sides of the rafters. A hold down plate with screws is also provided. The screws can penetrate into the cavities securing the exterior sides of adjacent rafters. The cavities contain the ends of the screws so that the screws do not penetrate into the isolated environment with the resultant possibility of gas or fluid leaks.

The system further includes a structural support means for supporting the plurality of panel structures. The structural support means include a plate upon which the interior sides of the two adjacent rafters can rest. The structural support means further includes latch means for securing the interior sides to the plate. These latch means are more loose fitting than the hold down plate and screws which hold the exterior sides together. Thus, these loose fitting latches allow the above indicated pivoting action to occur and allow for ease of assembly as alignment is not a critical consideration.

DETAILED DESCRIPTION OF THE PREFERRED EMBODIMENTS

Figure 1:
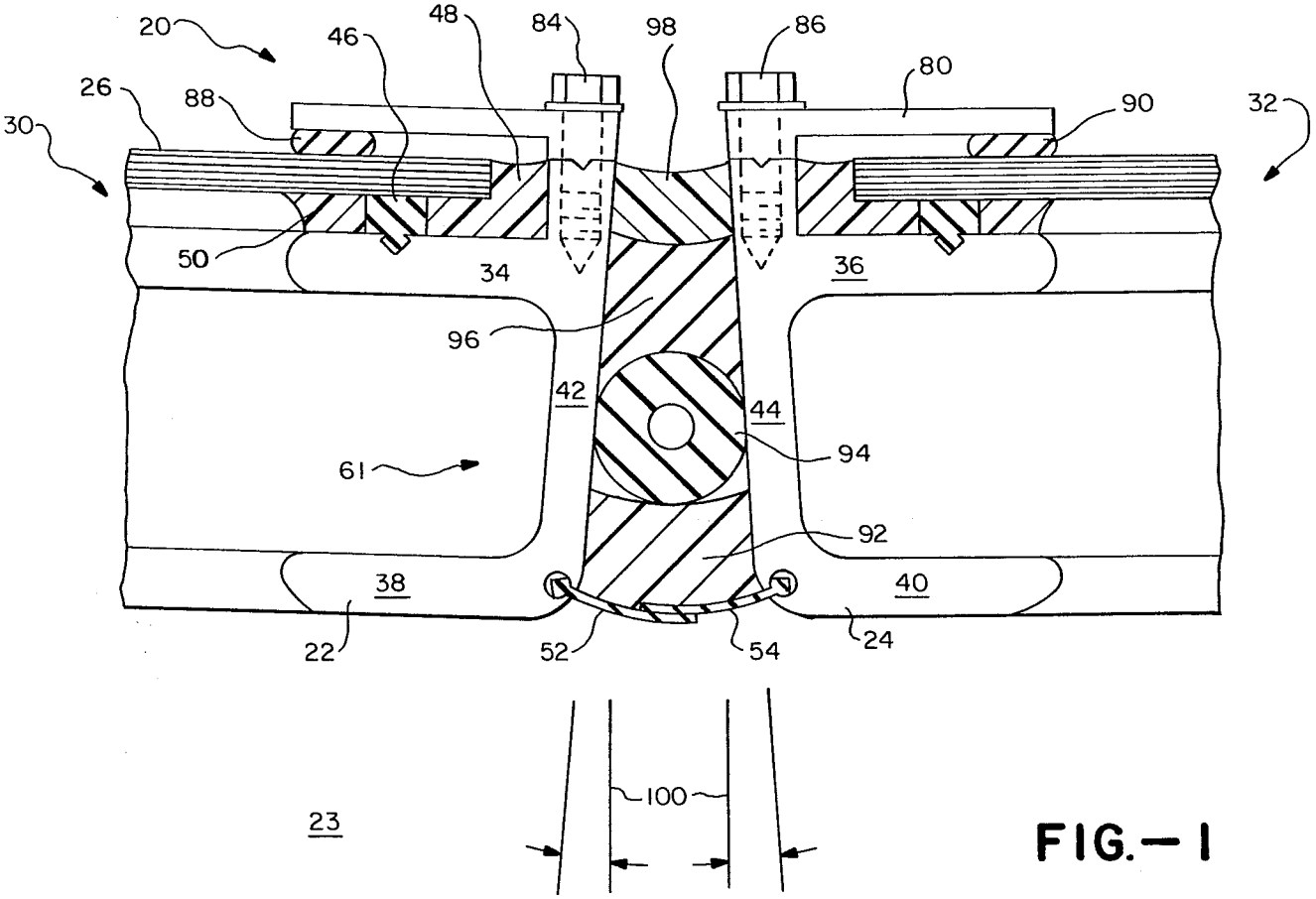
FIG. 1 is a side cross-sectional view of the invention.

With reference to the FIGS., and in particular FIG. 1, the panelized enclosure system of the invention is depicted and generally identified by the number 20. Number 21 identifies the location of the ambient environment and number 23 identifies the location of the isolated environment.

The panelized enclosure system 20 includes a plurality of rafters such as rafter 22 and rafter 24. Rafter 22, 24 generally form a rectangular frame upon which is positioned panels such as panels 26, 28. Rafters 22, 24 and panels 26, 28 form the panel structures 30, 32 of the invention which are the modular components which can be properly secured together. It is to be understood that the panels 26, 28 can be comprised of any desired material or combination of materials including transparent thermalpane materials.

Rafters 22, 24 include exterior sides 34, 36, interior sides 38, 40 and adjoining and adjacent peripheral sides 42, 44. These sides come together to form a rafter within substantially C-shaped cross-section. In a preferred embodiment, the rafters 22, 24 are provided by appropriate extrusion processes.

As can be seen in FIG. 1, the peripheral side of each rafter 22, 24 slopes inwardly from the exterior side to the interior side such that two adjacent rafters define a reverse camber there between which becomes more enlarged as the distance between the peripheral sides increase in the direction going toward the interior sides.

As can be seen in FIG. 1, each of the peripheral sides is provided at an angle from the horizontal which is defined by lines 100.

The panels 26, 28 are secured to the rafters 22, 24 as follows. First, a gasket which in a preferred embodiment is a silicone extruded gasket such as gasket 46, is secured to the exterior side 34 of a rafter. The panel 26 is placed on the gasket. Then, appropriate sealants are applied between the rafter 22 and the panel 26. In a preferred embodiment, a silicone sealant 48 is provided in a position as shown which is partially exposed to the environment. Further, in a preferred embodiment, a butyl rubber sealant 50 is provided between the panel 26 and the rafter 22 in a position which is sheltered from the external environment yet open to the isolated environment.

The silicone sealant has properties of being a better liquid sealant and also has a longer life span when exposed to weathering of the environment and is resistant to degradation due to ultraviolet light. The butyl rubber sealant is impermeable to gases.

The panel structures 30, 32 are assembled in a clean factory environment and provided ready for assembly at any desired site.

As will be discussed more fully below, each of the rafters 22, 24 is provided with completely enclosed internal cavities 52, 54 which are used to secure the rafters 22, 24 together.

Extending from the rafters 22, 24 at about the intersection of the interior and peripheral sides are first and second finger gaskets 52, 54. In a preferred embodiment, the finger gaskets are comprised of an extruded dense silicone material. Each finger gasket forms a continuous concave surface, with one finger gasket overlapping the other finger gasket as seen in FIG. 1. The finger gaskets provide a back support for the application of the sealants as described hereinbelow.

Figure 2:
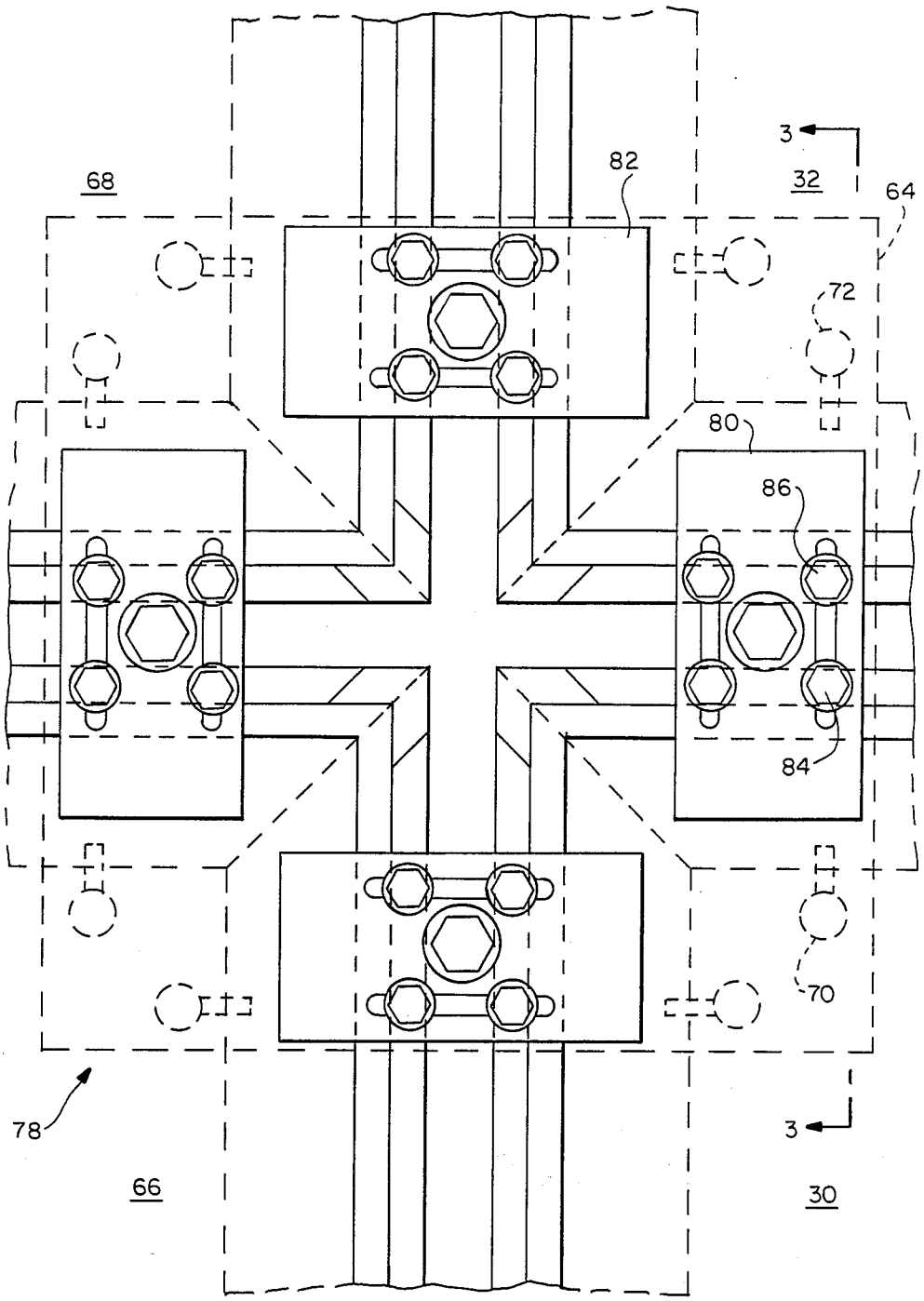
FIG. 2 is a plan view of an aspect of the invention where four panel structures are joined.
Figure 3:
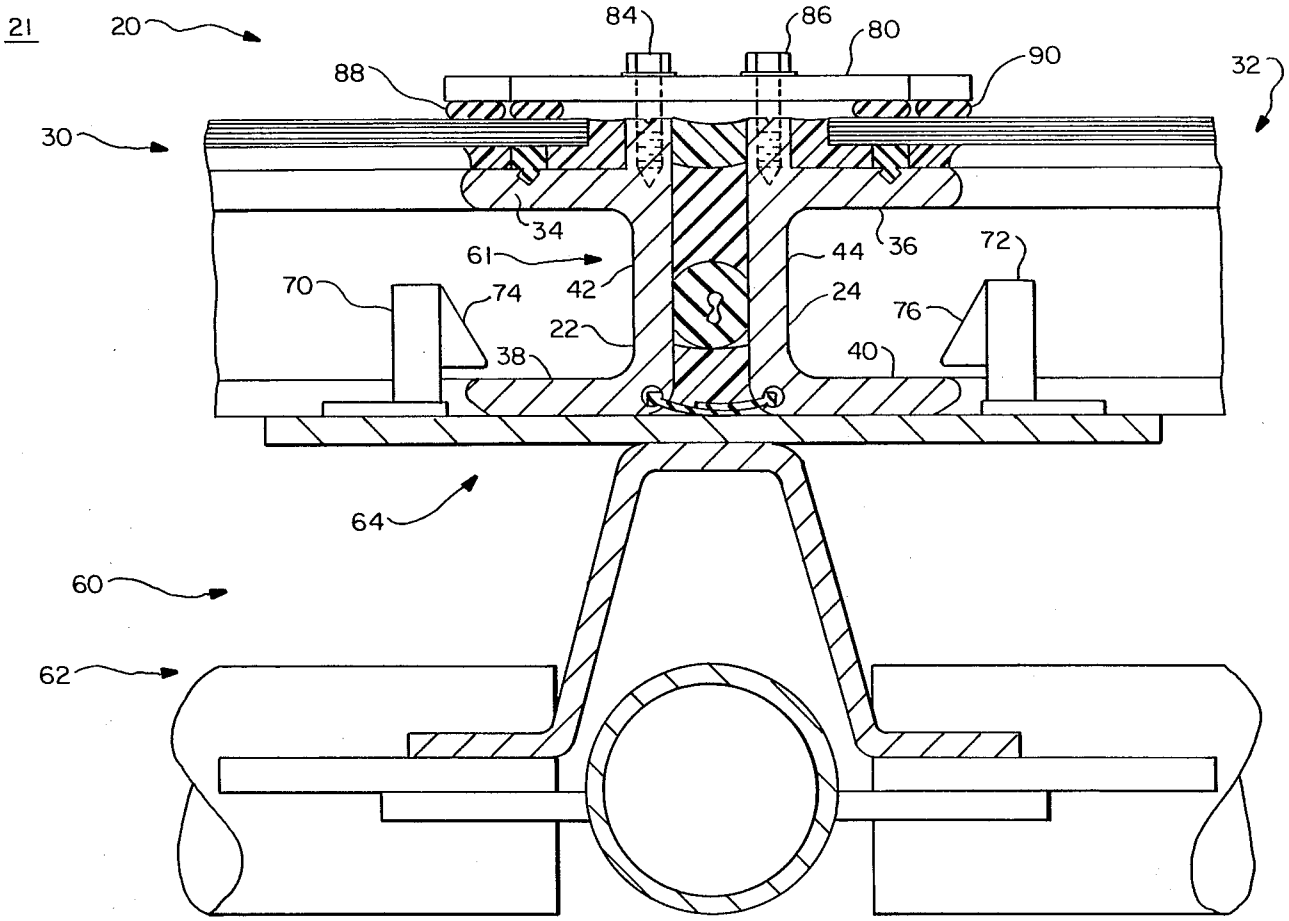
FIG. 3 is a cross-sectional view taken through line 3—3 of FIG. 2.

With reference to FIG. 3, additional aspects of the interconnection mechanism 60 and the sealing mechanism 61 of the invention are depicted. These aspects include a support structure 62 which in a preferred embodiment comprises a framework of hollow pipes. Secured to this framework is a support platform 64 which defines a node where the corners of four panel structures 30, 32, 66, 68 are secured (FIG. 2). Each support platform 64 includes a plurality of spring loaded latches such as latches 70, 72 which are capable of lockingly positioning the interior sides of the rafters. Each latch 70, 72 includes a spring loaded keeper 74, 76 which is urged out of the way as the interior side is urged into position and which springs back to retain the interior sided position. At a node (FIG. 2) where four panel structures are secured together, four pairs of latches are provided so that the four pair of adjacent interior sides of the four panels can be secured.

Accordingly, the panel structure can be quickly and conveniently snapped into position and held in position by the support structure 62.

As is evident from FIG. 3, latches 70, 72 losely secure the panel structures to the support structure 62. The panel structures are more securely secured thereby hold down plates such as plates 80, 82 (FIG. 2) and self tapping screws 84, 86. The plates such as plates 80, 82 are held against the panel structures 30, 32 in a preferred embodiment by self tapping screws 84, 86 which tap into the internal cavities 50, 54. Further, the plates are supported in position by glazing tape such as identified at numbers 88, 90. As the cavities 52, 54 are enclosed, the cavities receive the self tapping screws 84, 86, allowing space for the screws and also preventing escape or infiltration of gases or liquids as the screws do not penetrate through the rafters 22, 24.

Finally, the sealant is applied between the panel structures 30, 32 as follows. Initially, in a preferred embodiment, an application of a silicone sealant is provided at 92, adjacent the fingers 52, 54. Then a backer rod 94 is positioned adjacent the silicone sealant at 92. Adjacent the backer rod 94 and between the peripheral sides 42, 44 and in a preferred embodiment, butyl rubber sealant 96 is positioned. Finally, between the peripheral sides 42, 44 and adjacent the butyl rubber sealant 96 and the exterior sides 34, 36 another application of silicone sealant 98 is applied.

The silicone sealant is applied due to its adhesive qualities and its long life even though exposed to ambient environmental weathering conditions. The silicone is impermeable to liquids. The butyl rubber sealant is provided as it is impermeable to gases. The butyl rubber sealant is protected from the environment by the silicone sealant, due to the butyl rubber sealant's inability to tolerate environmental conditions such as ultraviolet light.

Industrial Applicability

In accordance with the above description, the panelized enclosure system 20 of the invention provides an enclosure for defining an isolated environment which is isolated from gases or liquids from the ambient environment. As is often the case, the isolated environment is held under pressure which is equal to or slightly above the ambient pressure. Thus, there tends to be an outward pressure on the panel structure 30, 32. As outward pressure is applied, the seal provided by the invention becomes even more strong due to the urging of the peripheral sides of the rafter work closely together as they pivot about the plate 80 compressing the sealant between the peripheral sides which form a reverse camber. The rafters are free to accomplish this compression due to the looser securing arrangement of the interior side of the rafter with respect to the spring loaded latches 70, 72. As is evident, the panel structures are easily positioned and do not require exacting alignment due to the loose fit afforded by the latches 70, 72.

Aspects, advantages and options of the invention can be obtained from a review of the figures and the appended claims. It is to be understood that even though the invention is described with respect to one embodiment, a multiplicity of embodiments are possible and still come within the scope of the invention.

What is claimed:

1. A panelized enclosure system including:

a plurality of panel structures each having a panel and a rafter means for supporting each panel;

interconnection means for flexibly interconnecting said panel structures to form the enclosure system;

sealing means for sealing said panel structures together to form an enclosure system;

each rafter means including a rafter with an exterior side, an interior side and a peripheral side joining the exterior and interior sides, and positioned by the interconnecting means adjacent the peripheral side of an adjacent rafter; and wherein said sealing means includes:

(a) a finger gasket means extending from at least one of two adjacent rafters toward the other adjacent rafter; and wherein said finger gasket means includes:

(a) a first finger gasket extending from a first rafter toward an adjacent second rafter;

(b) said first finger gasket secured to said first rafter about where the peripheral and interior sides of said first rafter meet;

(c) a second finger gasket extending from said second rafter toward said first rafter;

(d) said second finger gasket secured to said second rafter about where the peripheral and interior sides of said second rafter meet, said second finger gasket overlapping said first finger gasket.

2. A panelized enclosure system including:

a plurality of panel structures each having a panel and a rafter means for supporting each panel;

interconnection means for flexibly interconnecting said panel structures to form the enclosure system;

sealing means for sealing said panel structures together to form an enclosure system;

each rafter means including a rafter with an exterior side, an interior side and a peripheral side joining the exterior and interior side, and positioned by the interconnecting means adjacent the peripheral side of an adjacent rafter; and wherein said sealing means includes:

(a) a backer rod positioned between adjacent rafters;

(b) a gas impermeable sealant positioned between adjacent rafters and adjacent said backer rod;

(c) a weather resistant sealant positioned between adjacent rafter, adjacent said gas impermeable sealant, and adjacent said exterior sides of rafters.

3. A panelized enclosure system including:

a plurality of panel structures each having a panel and a rafter means for supporting each panel;

interconnection means for flexibly interconnecting said panel structures to form the enclosure system;

sealing means for sealing said panel structures together to form an enclosure system;

each rafter means including a rafter with an exterior side, an interior side and a peripheral side joining the exterior and interior sides, and positioned by the interconnecting means adjacent the peripheral side of an adjacent rafter;

each peripheral side sloping inwardly from said exterior side to said to said interior side such that adjacent peripheral sides define a reverse camber there between in the direction from the exterior side to the interior side; and wherein said sealing means includes:

(a) a finger gasket means extending from at least one of two adjacent rafters toward the other adjacent rafter;

(b) said finger gasket means positioned about where the peripheral side meets the interior side of a rafter;

(c) weather resistant sealant positioned between adjacent peripheral sides of adjacent rafter and adjacent to said finger gasket means;

(d) a backer rod positioned between adjacent peripheral sides and adjacent to said weather resistant sealant;

(e) gas impermeable sealant positioned between adjacent peripheral sides and adjacent to said backer rod; and (f) additional weather resistant sealant positioned between adjacent peripheral sides and adjacent to said gas impermeable sealant and the exterior sides of the panels.

4. A panelized enclosure system including:

a plurality of panel structures each having a panel and a rafter means for supporting each panel;

interconnection means for flexibly interconnecting said panel structures to form the enclosure system;

sealing means for sealing said panel structures together to form an enclosure system;

each rafter means including a rafter with an exterior side, an interior side and a peripheral side joining the exterior and interior sides, and positioned by the interconnecting means adjacent the peripheral side of an adjacent rafter;

said interconnection means for securing the panel structures adjacent said interior sides and said exterior sides; and wherein said interconnecting means includes:

(a) structural support means for supporting said plurality of panel structures;

(b) said structural support means including a plate means upon which rests interior sides of two adjacent rafters; and (c) said structural support means including latch means for receiving and lockingly positioning each of said interior sides of said rafter means.

5. The system of claim 4 wherein said interconnecting means further includes:

an internal cavity formed in the exterior side of a rafter;

hold down plate means including screw means for securing the exterior sides of adjacent rafter together;

said screw means being received in said internal cavity.

* * * * *

UNITED STATES PATENT AND TRADEMARK OFFICE

CERTIFICATE OF CORRECTION

PATENT NO. : 4,761,927

DATED : August 9, 1988

INVENTOR(S) : O'Keeffe, et al.

It is certified that error appears in the above-identified patent and that said Letters Patent is hereby corrected as shown below:

Column 1, line 44: "losely secure" should be -- loosely secure--

Column 3, line 59: "losely secure" should be --loosely secure--

Column 5, line 49: "to said to said" should be -- to said --

Signed and Sealed this

Twelfth Day of September, 1989

*Attest:*

*Attesting Officer*

DONALD J. QUIGG

*Commissioner of Patents and Trademarks*